US005761379A

United States Patent [19]

Lannes

[11] Patent Number: 5,761,379

[45] Date of Patent: Jun. 2, 1998

[54] WATER HEATER CAPABLE OF BEING HUNG FROM A SUPPORT

[75] Inventor: Eric M. Lannes, Kentwood, Mich.

[73] Assignee: Bradford White Corporation, Ambler, Pa.

[21] Appl. No.: 557,601

[22] Filed: Nov. 14, 1995

[51] Int. Cl.[6] ..... B23C 65/00; F24H 1/18

[52] U.S. Cl. ..... 392/451; 220/444; 392/449; 126/363; 126/344

[58] Field of Search ..... 392/449–454; 220/444; 248/313; 126/344, 361, 362, 363; 122/4 A, 13.1, 13.2

[56] References Cited

U.S. PATENT DOCUMENTS

| | | | |
|---|---|---|---|
| 193,860 | 8/1877 | Frazier . | |
| 1,713,685 | 5/1929 | Austin . | |
| 3,134,890 | 5/1964 | Teter . | |
| 3,151,614 | 10/1964 | Mendelson . | |
| 4,917,077 | 4/1990 | Scanferia . | |
| 4,955,573 | 9/1990 | Horvath . | |
| 4,992,223 | 2/1991 | Nelson . | |
| 5,000,893 | 3/1991 | West et al. . | |
| 5,052,347 | 10/1991 | Nelson . | |
| 5,131,133 | 7/1992 | Peterson et al. . | |
| 5,208,964 | 5/1993 | Nelson . | |
| 5,229,048 | 7/1993 | Nelson . | |
| 5,682,666 | 11/1997 | Lannes | 392/449 |

FOREIGN PATENT DOCUMENTS

| | | | |
|---|---|---|---|
| 1507 | of 1926 | Australia . | |
| 102193 | 12/1925 | Austria . | |
| 106772 | 7/1967 | Denmark . | |
| 667752 | 10/1929 | France . | |
| 2012302 | 9/1971 | Germany . | |
| 3427399 | 1/1986 | Germany | 392/449 |
| 154745 | 5/1932 | Switzerland | 126/361 |
| 253431 | 11/1948 | Switzerland | 392/451 |
| 462417 | 10/1968 | Switzerland | 392/451 |
| 477298 | 12/1937 | United Kingdom . | |
| 1548366 | 7/1976 | United Kingdom . | |
| 2059555 | 4/1981 | United Kingdom | 392/451 |
| 2222871 | 3/1990 | United Kingdom . | |

*Primary Examiner*—John A. Jeffery
*Attorney, Agent, or Firm*—Austin R. Miller

[57] ABSTRACT

A water heater is capable of being hung from a support, and includes a water tank, a water inlet, a water outlet, and a jacket positioned around the water tank so as to define a space between the water tank and the jacket. Foam insulation is positioned in the space between the water tank and the jacket, and the foamed insulation has increasing density and cell uniformity gradients in a direction running from a first portion to a second portion of the water heater. A curved bracket assembly is positioned on the second portion of the jacket to coincide with the positioning of foam insulation having highest density and best cell uniformity. A bumper is optionally positioned on the outer surface of the jacket and is vertically aligned with the bracket assembly.

8 Claims, 6 Drawing Sheets

WATER HEATER CAPABLE OF BEING HUNG FROM A SUPPORT

FIELD OF THE INVENTION

This invention relates to a water heater capable of being hung from a support. In particular, this invention relates to a water heater capable of being hung from a substantially vertical wall.

The floor space consumed by standard domestic or commercial water heaters presents a problem in situations where space is limited. Conventional water heaters must be floor-supported, which severely restricts the positioning options available for a water heater in a limited-space situation. Clearly, the ability to hang a water heater from a support, particularly a substantially vertical wall, would advantageously clear floor space which would otherwise be consumed by a standard water heater.

Much less obvious, however, are other unique demands placed on hangable water heaters that do not confront conventional floor-supported water heaters and thus are left completely unaddressed in conventional water heater designs. One unique yet critical demand placed on a hangable water heater concerns insulating the water tank so that a mounting assembly used to hang the water heater does not compromise the thermal integrity of the water heater, particularly at the top portion of the installed unit where the hottest water resides.

Government regulations require that water heaters meet strict efficiency standards, thereby necessitating a hangable water heater construction that minimizes heat loss even when the water heater is hung from a convenient but typically cold support, such as a basement or garage wall, on a mounting assembly constructed from an inexpensive but highly heat-conductive material, such as steel. Simply adding more insulation to achieve the required efficiencies increases the size of the water heater, and thus conflicts with the stated purpose for hanging a water heater; i.e. the conservation of space. In addition, smaller water heaters are less costly to ship and easier to install.

DESCRIPTION OF THE PRIOR ART

The patent to West et al U.S. Pat. No. 5,000,893, assigned to Bradford White Corporation, discloses a process of forming a high-density foam between a water heater tank and jacket, by applying a so-called two-shot foaming method. A partial shot is introduced into the applicable space and is later followed by a second shot with the top pan immediately secured over the outer jacket upon completion of the second shot. In this way the foam in the second shot will be expanding within a closed container and is therefore subjected to higher pressures as it foams. This, as reported in the reference, causes the foam injected in the second shot to form a denser foam than the free-rising foam injected in the first shot.

Further, Nelson U.S. Pat. Nos. 4,992,223 and 5,208,964 disclose methods wherein the insulation foaming process is initiated at the top portion of an inverted water heater. As a result, high-quality foam insulation in terms of cell uniformity, density and insulating ability is produced at what becomes the top portion of the water heater. The Nelson patents teach that the clearance space above the inner water tank is foamed first, thereby assuring that the foam material at this location will have greater uniformity in foam density and cell structure than at the lower portion of the annular space, so as to provide enhanced thermal efficiency at the most critical location, namely, in the space between the top of the water tank and the top pan of the water heater. The water heaters of the Nelson patents are intended for floor-mounting, with the plumbing fittings for inlet water and outlet water located at the top pan. There is no suggestion in the Nelson patents of the concept of positioning high-quality insulating foam between any mounting assembly of a hangable water heater and a water tank to protect against heat loss via conduction through the mounting assembly itself.

The teachings of the aforementioned prior art references show inconsistent findings as to what portion or portions of poured foam have the best consistency or uniformity of foam density and cell structure. The Nelson patents appear to suggest that the best foam is created at the bottom of the pour, while the West patent indicates that, particularly when the top pan is immediately secured in place, the best foam occurs at the top of a pour because of the pressure created by the presence of the top pan. Accordingly, there is confusion, or at least inconsistency, in the prior art as to where and in what manner an optimum foam efficiency may be obtained in a particular case.

OBJECTS OF THE INVENTION

It is an object of the invention to provide a foam-insulated water heater capable of being wall-hung from a support, and wherein insulating foam is provided with optimum characteristics of foam density and uniformity in the area adjacent the support.

It is another object of the invention to provide a thermally insulated hangable water heater that remains in a substantially vertical position when hung from a substantially vertical wall.

It is still another object of the invention to provide a thermally insulated hangable water heater which is capable of being installed in close proximity to an overhead obstruction, such as a ceiling, with generally vertically-oriented bottom-entry tubes for water inlet and water outlet.

It is another object of the invention to provide a bracket assembly for hanging a water heater on a wall or the like, which maintains the roundness of a substantially cylindrical enclosure encompassing a water tank and, consequently, the water tank's centered position relative to the enclosure.

It is another object of the invention to adhere a foam insulation to both the water tank and enclosure encompassing the water tank of a water heater capable of being hung from a support, wherein the foam insulation provides a strengthening effect which stabilizes the position of the water tank within the water heater.

It is yet another object of the invention to provide a water heater capable of being hung from a support, wherein a chemically-foamed insulation is located between the water tank and the outer enclosure, the insulation possessing density and cell uniformity gradients such that high-quality insulating foam is present between the water tank and a mounting assembly used to hang the water heater.

Other objects and advantages of the invention will become apparent to those skilled in the art from the drawings and the following description.

SUMMARY OF THE INVENTION

The invention provides a water heater capable of being hung from a support, attached to a vertically-oriented surface such as a cold wall. The water heater includes a water tank and a substantially cylindrical outer jacket surrounding the water tank. The space between the water tank and the outer jacket is filled with foam insulation having cell uniformity and density gradients such that foamed insulation having the best and most uniform density, uniform cell structure, and high thermal efficiency is positioned adjacent to a bracket assembly provided for hanging the water heater. Further, the foam insulation adheres to both the water tank and outer jacket to provide a strengthening effect which stabilizes the position of the water tank within the water heater.

The bracket includes an inner bracket portion positioned within the inside surface of the outer jacket and an external wall bracket positioned on the outside surface of the outer jacket. Both the inner bracket portion and the wall-engaging bracket are curved, but the inner bracket may be of less curvature than the outer jacket. The entire bracket assembly is positioned to coincide with the positioning of the best and most dense foamed insulation and, unlike other designs, the inner bracket is not mounted on the water tank itself. Thus, the critical area extending between the bracket assembly and the water tank is filled with the foam or fiberglass or other insulation having the best insulating qualities. This structure has been found to be highly effective in limiting loss of heat from the water heater even when the bracket is made of inexpensive metal or any other good conductor of heat.

As mentioned, the bracket assembly is curved but need not necessarily coincide with the curvature of the outer jacket. The inner bracket may be of less curvature than the outer jacket, with the intervening space filled with insulation, thereby preserving the substantially cylindrical shape of the outer jacket. This promotes even circumferential spacing between the outer jacket and the water tank, and allows the use of the same size bracket for a variety of tank diameters.

The invention further provides a preferable combination of the aforementioned bracket with a bumper positioned on the bottom portion of the outside surface of the water heater and vertically aligned with the bracket assembly. The bumper coacts with the bracket to maintain the water heater in a substantially vertical position when hung from a substantially vertical wall or the like.

DETAILED DESCRIPTION OF THE INVENTION

Figure 1:
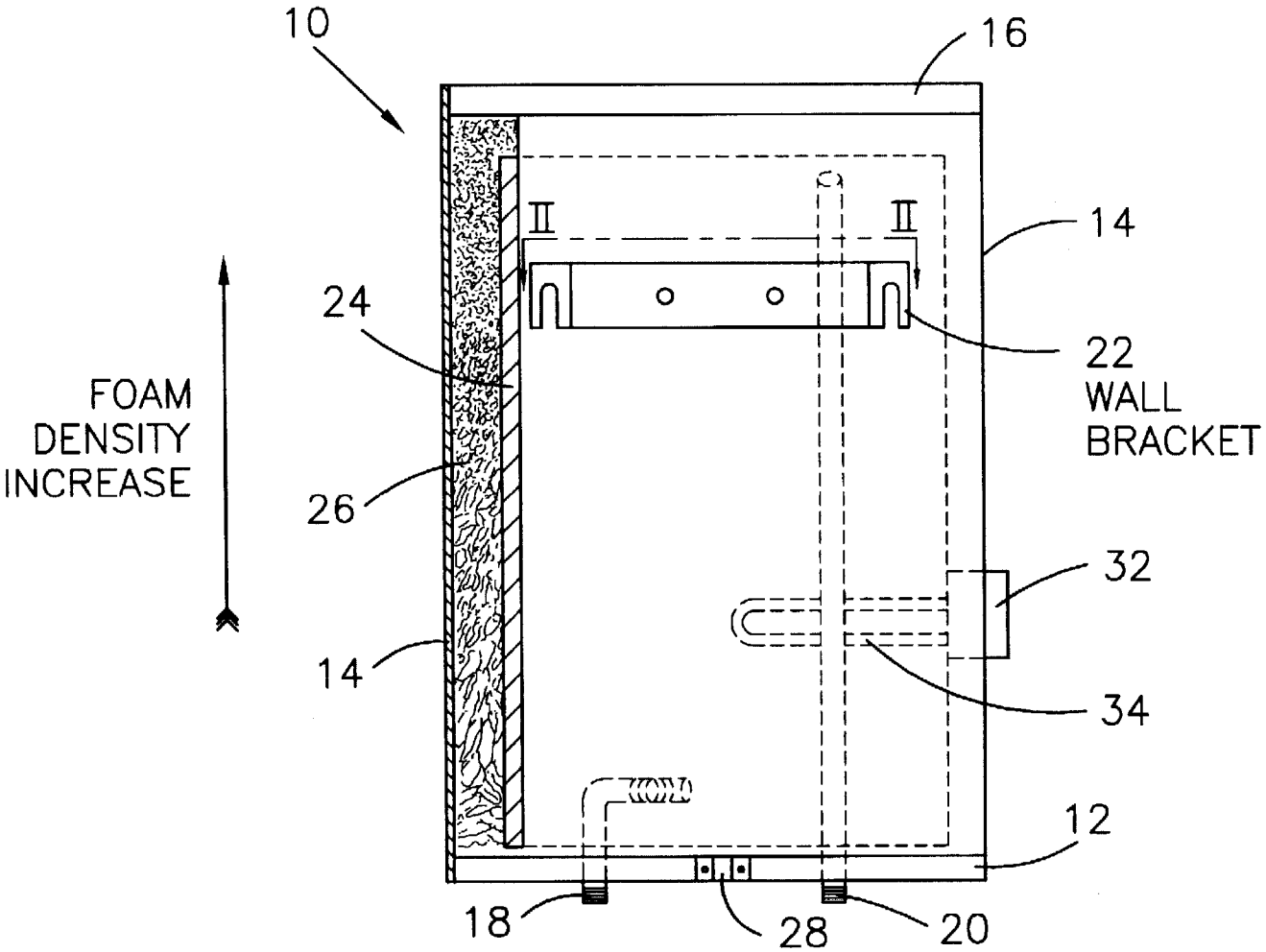
FIG. 1 is a simplified schematic front elevational view of a water heater embodying features of the invention, with a portion broken away and shown in section for ease of understanding, and showing in an exaggerated form certain gradations of foam density and uniformity of the foam insulation.

Although a particular form of apparatus has been selected for illustration in the drawings, and although specific terms will be used in this Specification for the sake of clarity in describing the apparatus, the scope of this invention is not intended to be limited either by the drawings selected or the terms used in this description, but is defined in the appended claims.

Referring now to FIG. 1, a water heater 10 capable of being hung from a substantially vertical wall is shown. Water heater 10 includes water tank 24, outer jacket 14, top pan 16, bottom pan 12, cold water inlet 18, and hot water outlet 20, both connected through the bottom pan 12 into the tank 24. Although cold water inlet 18 is shown as having a right-angle bend, it can be of any desired format, including the cold water inlet deflector means shown in my U.S. Pat. No. 5,341,770, for example.

Foam insulation 26 is positioned between and adhered to both outer jacket 14 and water tank 24. Heating and control apparatus 32 may be mounted in any desired position to the wall of water tank 24 to supply heat to the water contained within water tank 24. A wall bracket 22 is positioned below the top of water heater 10 on the outer surface of outer jacket 14. In this embodiment of the invention, a bumper 28 is secured to the bottom portion of water heater 10 below wall bracket 22 and extends substantially the same distance radially away from outer jacket 14 as does wall bracket 22. Heating coil 34 is provided for heating water in water tank 24, though any conventional gas, oil, or electrical heating means known in the art may be used.

Figure 2:
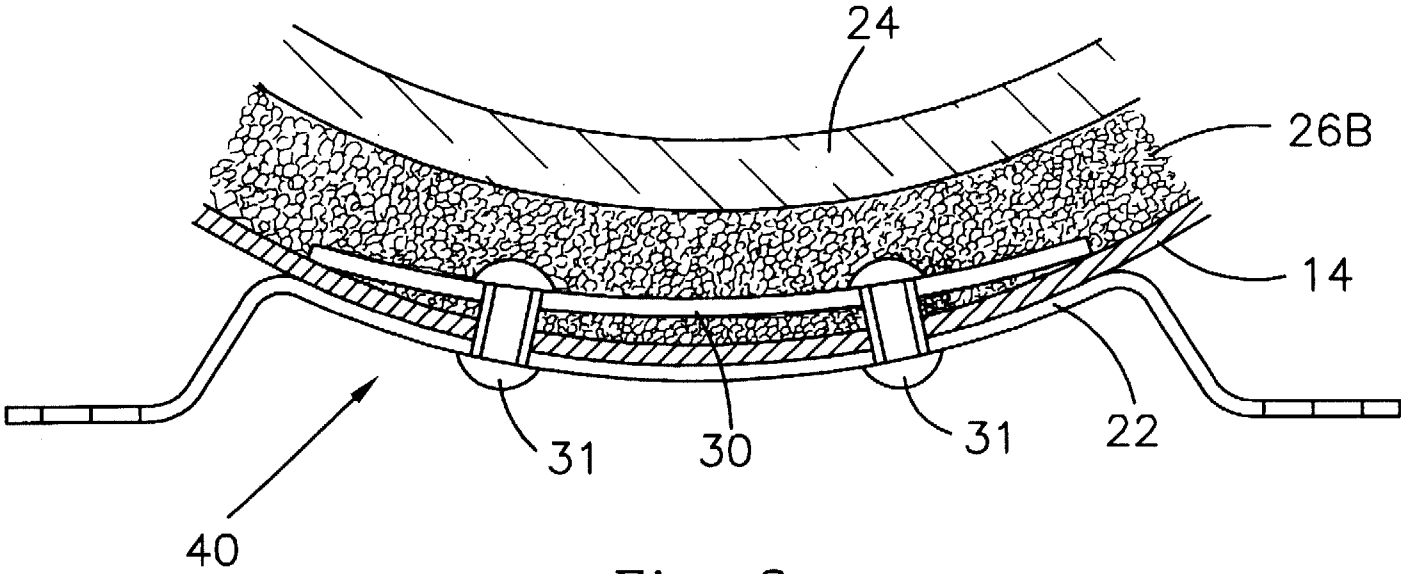
FIG. 2 is a fragmentary sectional top plan view of the water heater bracket assembly of FIG. 1, taken as indicated by the lines and arrows II—II which appear in FIG. 1.

FIG. 2 shows one form of a wall-mounting bracket assembly 40. Wall bracket 22 is positioned on the outside surface of outer jacket 14, while inside bracket 30 is aligned with wall bracket 22 on the inside surface of outer jacket 14. Wall bracket 22 is curved to conform to the curvature of outer jacket 14, while inside bracket 30 is shown to be of less curvature than outer jacket 14. Wall bracket 22 is secured to inside bracket 30 by bolts 31 or other suitable means. Bolts 31, wall bracket 22 and inside bracket 30 are often composed of strong, inexpensive but highly heat-conductive metals to minimize cost. High-quality, small-cell and uniform foam insulation 26B is shown positioned between inside bracket 30 and water tank 24, and between inside bracket 30 and outer jacket 14.

Figure 3:
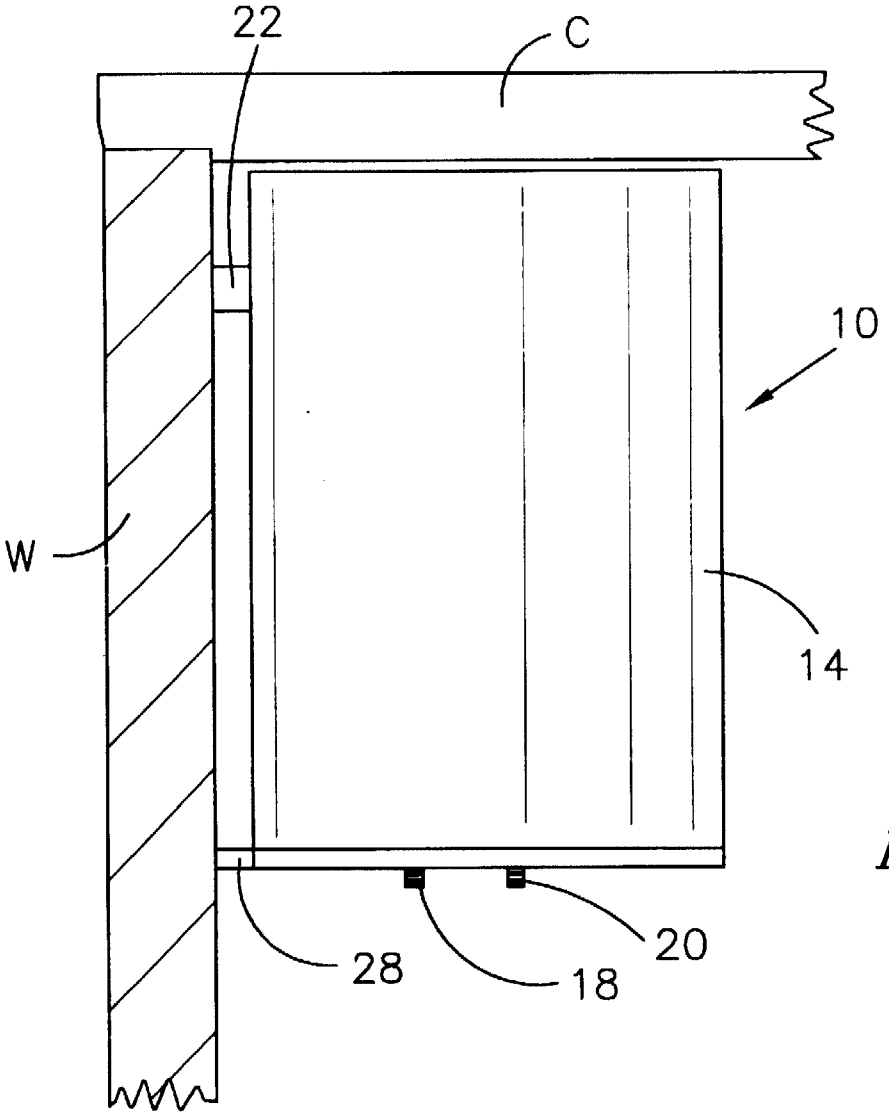
FIG. 3 is a simplified schematic side elevation of the water heater of FIG. 1, hung from a substantially vertical wall W.

FIG. 3 is a schematic depiction of a water heater 10 hung from a substantially vertical wall W. Wall bracket 22 and bumper 28 are vertically aligned and extend from outer jacket 14 so that water heater 10 remains in a substantially vertical position when hung. Water inlet 18 and water outlet 20 are positioned on the bottom portion of water heater 10 so that water heater 10 may be hung adjacent to a ceiling C or other overhead obstruction. Bumper 28 is optional.

Figure 5:
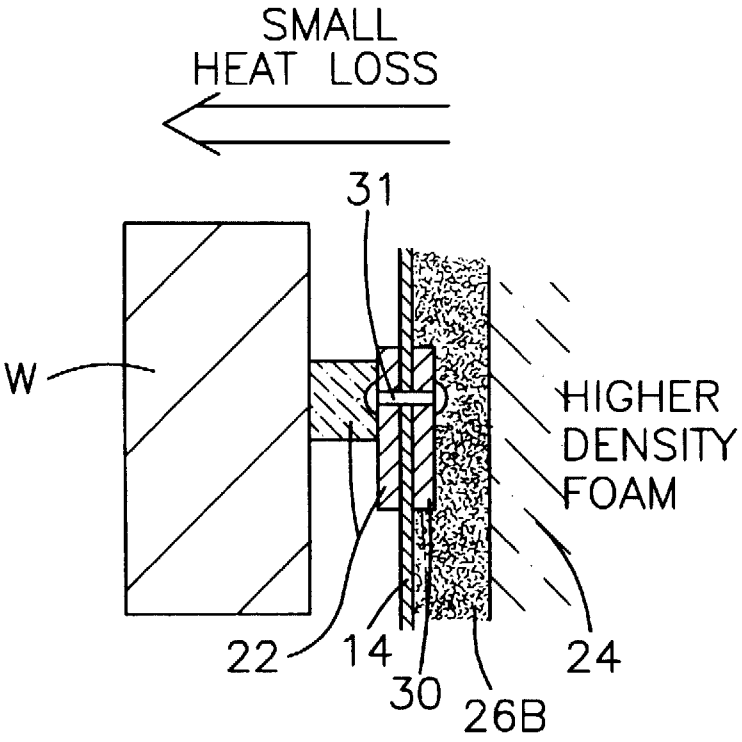
FIG. 5 is a fragmentary sectional view of a water heater in accordance with this invention, with minimized heat loss through the bracket area in the presence of high density, highly-uniform foam insulation.
Figure 4:
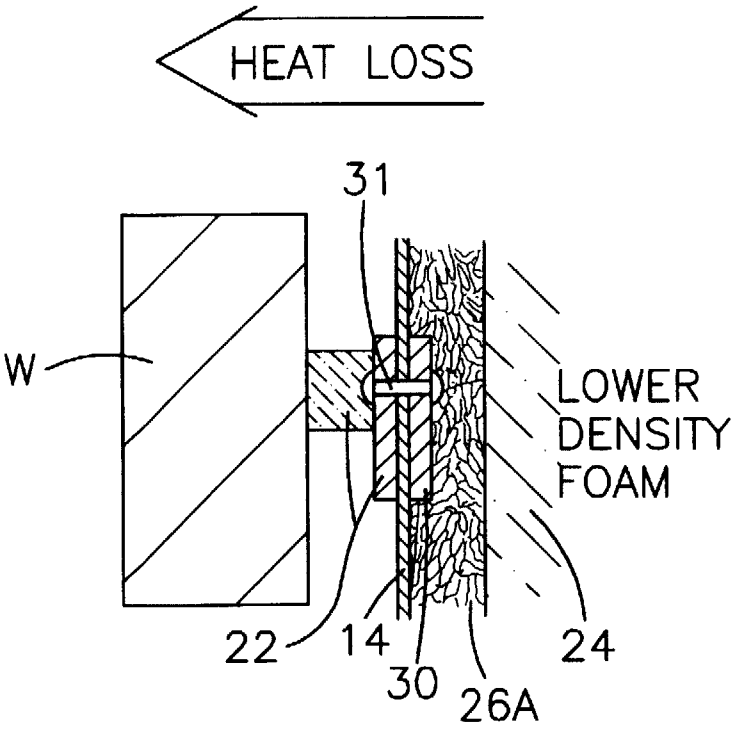
FIG. 4 is a fragmentary sectional view of a hangable water heater, taken in section, showing heat loss when the space between the water tank and the bracket is insulated with low density, non-uniform foam insulation.

FIGS. 4 and 5 show the different heat losses that occur through a bracket assembly when foam insulations having different densities and cell uniformities are used. In both FIGS. 4 and 5, the bracket assembly of an installed hangable water heater is shown. The water heater is hung from substantially vertical wall W by a bracket assembly consisting of wall bracket 22 and inside bracket 30. In FIG. 4, foam insulation 26A, having low density and a non-uniform cell structure of the kind located at the top of an open-top vertical pour, is positioned between outer jacket 14 and water tank 24. In FIG. 5, the foam insulation 26B possesses high density and uniform cell structure, and is positioned between outer jacket 14 and water tank 24 in the vicinity of the bracket members 22, 30 and the interconnecting bolts 31. The very different heat losses in the structures depicted in FIGS. 4 and 5 are shown schematically above the drawings, and indicate that an advantageously smaller heat loss through the bracket assembly is suffered when high-quality small-pore and uniform foam insulation 26B is used as compared with relatively low density, non-uniform foam insulation 26A at that location. Bolts 31 are significant avenues of heat loss since they extend from within outer jacket 14 to the bracket 22 which in turn is connected in heat exchanging relationship to the wall W, which is often cold enough to be a substantial heat sink.

Figure 6:
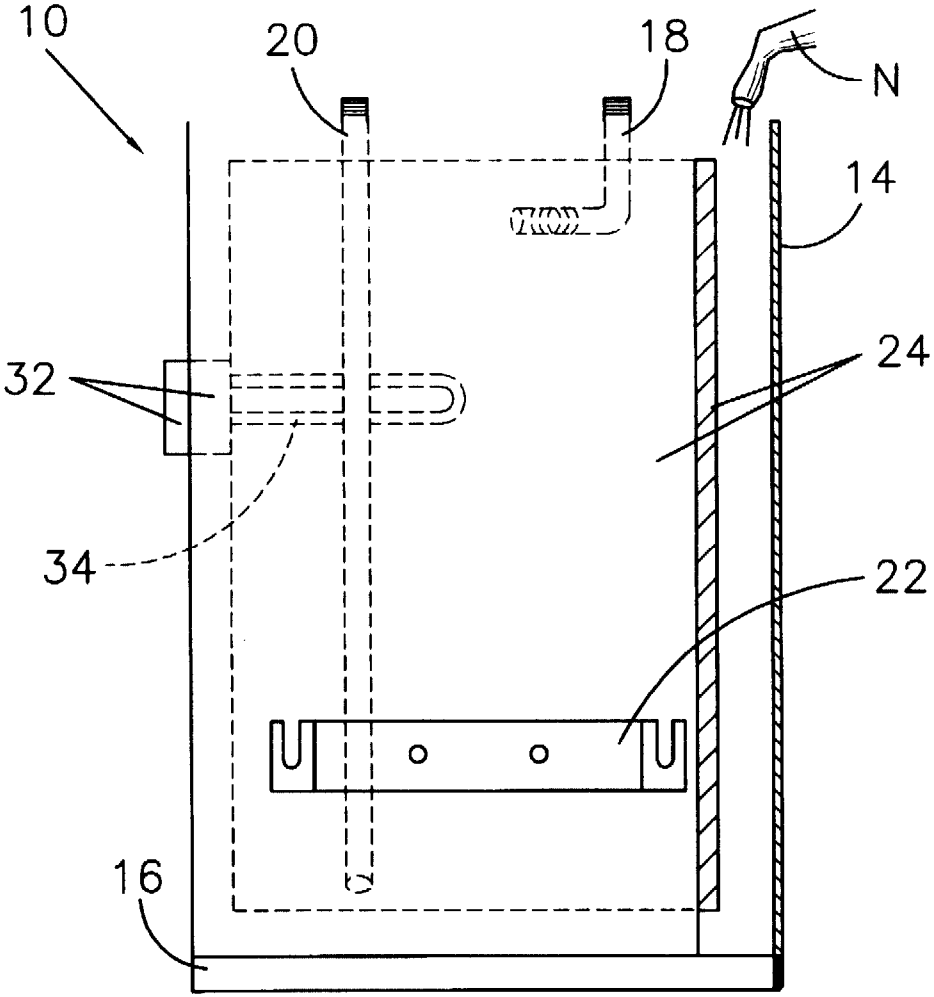
FIG. 6 is a simplified schematic front elevational view of a water heater showing one method of insulating a water heater embodying features of the invention, with a portion broken away and shown in section for ease of understanding.
Figure 7:
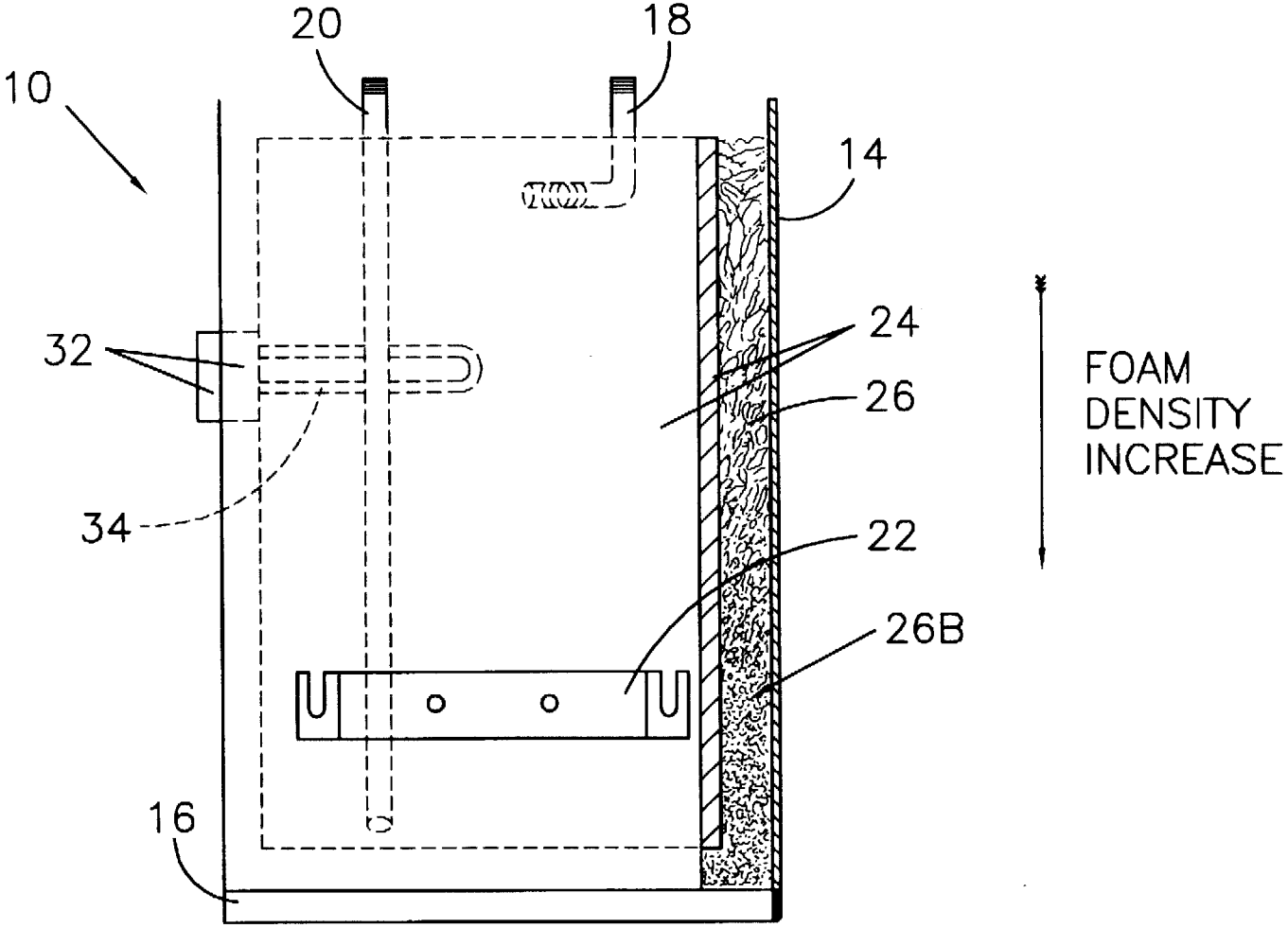
FIG. 7 is a simplified schematic front elevational view of the water heater shown in FIG. 6 after the foaming-insulation reaction is complete.

The nature and the structure of the novel hangable water heater of this invention may be further understood with respect to one manner in which it may be made. It has been discovered to be advantageous to construct the water heater upside down relative to its normal position in use. As shown in FIG. 6, all of the parts of the water heater are assembled except for the bottom pan and the foam insulation (numbers correspond to those used in previous figures). Chemicals which react to form the foam insulation are introduced downwardly from nozzle N through what will be the uncovered bottom portion of the water heater into the space between the water tank and outer jacket so that the foaming reaction commences at what will be the top portion of the water tank in its normal usage. Preferentially high quality foam under such reaction conditions is produced in the general area where the foaming reaction begins, which in this case is the bottom of the tank while pouring, which becomes the top portion of the water heater when oriented in its normal position in use. As shown in FIG. 7, dense and uniform insulation 26B is thus positioned between the water tank and the bracket assembly, which is also located adjacent to what will be the top portion of the water tank in normal use.

The hangable water heater structure disclosed herein provides many advantages over conventional water heaters. The invention is capable of being hung from a support, in particular a substantially vertical wall, which may well be an outside wall or a cold wall, further providing many unit positioning options for the efficient utilization of limited space. Locating the water inlet and water outlet at the bottom of the water heater allows the water heater to be hung close to a ceiling, thereby providing even greater positioning freedom. It also allows the water inlet and outlet pipes to be vertically oriented without installation problems.

Providing high-quality foam insulation in the top portion of the water heater between the water tank and hanger assembly prevents thermal compromise of the water heater unit. Such positioning eliminates any need for adding extra, cumbersome insulation to achieve required efficiency ratings, even when the water heater is hung from a cold support on a hanger assembly made from a highly heat-conductive material.

Adhering the foam insulation to both the water tank and outer jacket provides a strengthening effect which stabilizes the position of the water tank within the water heater. This stabilization effect is particularly important considering the substantial weight of a fully charged water tank.

The hanger assembly includes an inner bracket and an outer bracket, both curved but not necessarily to substantially conform to the shape of the outer jacket. When the curvatures conform, the hanger assembly preserves the substantially cylindrical shape of at least a portion of the outer jacket to promote even circumferential spacing between the outer jacket and water tank, thereby facilitating uniform foamed-insulation distribution around the water tank. However, the inner bracket may be made of lesser curvature so that one size bracket can be used for water heaters of various outside diameters. If flatness of the inner bracket creates space between the jacket and the inner bracket, that space becomes filled with foam, which serves as cushioning means or reinforcement for the jacket.

The bumper 28, vertically aligned with the hanger assembly and preferably extending the same distance from the water heater as does the hanger assembly, coacts with the bracket to ensure that a water heater mounted on a substantially vertical wall is oriented in a substantially vertical position. The bumper 28 greatly facilitates installation because piping hook-ups remain vertically aligned with pipe connections entering at the bottom of the tank. It may, however, be replaced by a separate bumper or protrusion on an adjacent wall.

In practical use of the water heater of this invention the heat loss even through the less dense portion of the foam is minimal since, in its installed position, the less dense foam is located at or near the bottom of the tank 24, where the stored water is at its lowest temperature.

Although this invention has been described in connection with specific forms thereof, it will be appreciated that parts may be reversed or even omitted, and that a wide variety of equivalents may be substituted for the specific elements described therein, all without departing from the spirit and the scope of this invention as defined in the appended claims. For example, the bracket assembly may be positioned anywhere on the water heater so long as foam or fiber or other insulation having preferential density and cell uniformity is positioned between the bracket and the water tank. Moreover, the bracket may be conformed to hang the water heater from a support other than a substantially vertical wall, such as a ceiling or a beam or even an object of irregular shape. Instead of being attached to the water heater, a bumper may be attached to the support from which the water heater is hung to maintain the water heater in a substantially vertical position. Many other variations may be practiced, all within the spirit and scope of the invention as defined in the appended claims.

What is claimed is:

1. A water heater capable of being hung from a support, comprising:

(a) a water tank;

(b) a water inlet positioned on said water tank;

(c) a water outlet positioned on said water tank;

(d) an enclosure positioned around said water tank so as to define a space between said water tank and said enclosure, said enclosure having an inner surface, an outer surface, a first portion and a second portion, said first portion being adjacent to said second portion;

(e) insulation positioned in said space between said water tank and said enclosure, said insulation having increasing density and uniformity gradients in a direction running from said first portion of said enclosure to said second portion of said enclosure; and (f) a bracket assembly for hanging said water heater, said bracket assembly being positioned on said outer surface of said enclosure at said second portion of said enclosure.

2. A water heater capable of being hung from a support, comprising:

(a) a water tank;

(b) a water inlet positioned on said water tank;

(c) a water outlet positioned on said water tank;

(d) a substantially cylindrical jacket positioned around said water tank so as to define a space between said water tank and said jacket, said jacket having an inner surface, an outer surface, and an upper portion located above a lower portion;

(e) foam insulation positioned in said space between said water tank and said jacket, said foam insulation having increasing density and cell uniformity in a direction running from said lower portion of said enclosure to said upper portion of said enclosure; and (f) a bracket assembly positioned for hanging said water heater on said outer surface of said jacket at said upper portion of said jacket.

3. The water heater according to claim 2, wherein said jacket is connected to a top pan and a bottom pan.

4. The water heater according to claim 2, further comprising a bumper positioned on said outer surface of said jacket, said bumper being substantially vertically aligned with and below said bracket assembly.

5. The water heater according to claim 4, wherein said support is a substantially vertical wall, and wherein said bumper and said bracket assembly extend substantially the same distance from said jacket so as to maintain said water heater in a substantially vertical position when hung from said substantially vertical wall.

6. The water heater according to claim 2, wherein said water tank has a top portion and a bottom portion relative to the position of said water heater when hung from a support, and wherein said water inlet and said water outlet are positioned adjacent said bottom portion of said water tank.

7. The water heater according to claim 2, wherein said bracket assembly comprises an inner bracket positioned on said inner surface of said jacket, and an outer bracket positioned on said outer surface of said jacket adjacent said inner bracket, said inner bracket being attached to said outer bracket.

8. The water heater according to claim 2, wherein said foam insulation is adhered to both said water tank and said jacket to stabilize the position of said water tank within said water heater.

* * * * *